US006047742A

United States Patent [19]

Barlasov

[11] Patent Number: 6,047,742

[45] Date of Patent: Apr. 11, 2000

[54] PLASTIC BAND TIGHTENING DEVICE WITH MODIFIED GRIPPING MECHANISM

[75] Inventor: Pavlo Barlasov, San Jose, Calif.

[73] Assignee: Teknika USA, Inc., San Jose, Calif.

[21] Appl. No.: 09/259,739

[22] Filed: Feb. 26, 1999

[51] Int. Cl.[7] ..... B21F 9/00

[52] U.S. Cl. ..... 140/123.6; 140/93.2

[58] Field of Search ..... 140/93.2, 93.4, 140/123.5, 123.6; 254/251, 252

[56] References Cited

U.S. PATENT DOCUMENTS 3,858,625 1/1975 Banjeglav ..... 140/93.2
4,252,158 2/1981 McDade ..... 140/123.6

*Primary Examiner*—Lowell A. Larson

*Attorney, Agent, or Firm*—The Kline Law Firm

[57] ABSTRACT

A tightening apparatus for strapping an object with a plastic band includes a holding mechanism with an eccentric shaft, a stationary gripper plate, and a moving gripper plate mounted on a shaft that moves within a slot on the frame of the device. The fact that the shaft moves within the slot allows the apparatus to function with the teeth of the moving gripper plate never touching the teeth of the stationary gripper plate in any position, thereby greatly increasing the useful life of the device. When a band is inserted into the device, only the rearmost rows of teeth on the moving gripper plate contact the band. The other teeth of the moving gripper plate are bought into contact with the band as the tightening force is applied. A return mechanism returns a windlass to an optimal loading position following each tightening operation.

2 Claims, 4 Drawing Sheets

PLASTIC BAND TIGHTENING DEVICE WITH MODIFIED GRIPPING MECHANISM

FIELD OF THE INVENTION

The present invention relates generally to band tightening devices, and more particularly is a plastic band tightening device with a modified gripping mechanism.

BACKGROUND OF THE INVENTION

The prior art includes several devices that utilize well known methods of applying tension to a strapping band. In one such design, one end of a band is held between stationary and moving toothed gripper plates. The moving gripper contacts a first end of the band with all its teeth simultaneously under the influence of a previously charged spring. An operator applies force to a tension handle of a tension mechanism that includes a windless. The windlass rotates and tightens a second end of the band threaded through one of its slots. When the pulling force is applied, a moving gripper plate acts as a force resolution wedge that increases a normal component of the pressing force so that the band is sufficiently held between the two plates. The efficiency of holding increases proportionally with an increase of the pulling force.

It is necessary in the current art designs to have a very strong spring in the mechanism and extremely sharp teeth on both the stationary and the moving plates in order to hold a heavy duty polyester band. The heavy duty polyester band, in contrast with a traditional polypropylene strap, has a hard and slick surface. At the end of each working cycle, when the apparatus is moved away from the band and a new band has not yet been loaded, the sharp teeth of the moving gripper plate (made from heat treated steel) are forced by the spring to strike against the sharp teeth of the stationary gripper plate (also made from heat treated steel). As a result of this interaction, all the teeth eventually lose their sharpness, and therewith their ability to prevent a band from slipping between them. This commonly used mechanism design is described in U.S. Pat. No. 5,181,546 to Synec, issued Jan. 26, 1993, and U.S. Pat. No. 4,056,128 to Konrad, issued Nov. 1, 1977.

Accordingly, it is an object of the present invention to provide a banding device that functions without the teeth of the moving gripper plate striking those of the stationary gripper plate.

It is a further object of the present invention to provide a device that returns the windlass automatically to an optimal loading position.

SUMMARY OF THE INVENTION

The present invention is a tightening device for strapping an object with a plastic band. The device comprises a holding mechanism with a stationary gripper plate and a moving gripper plate mounted on an eccentric shaft. The eccentrically mounted moving gripper plate allows the apparatus to function with the teeth of the moving gripper plate never touching the teeth of the stationary gripper plate in any position, thereby greatly increasing the useful life of the device. The device also includes a cutting means and a return mechanism that returns a tightening windlass to an optimal loading position following each tightening operation.

An advantage of the present invention is that it functions without the teeth of the moving gripper plate striking those of the stationary gripper plate.

Another advantage of the present invention is that the tightening windlass is automatically returned to an optimal loading position following each tightening operation.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
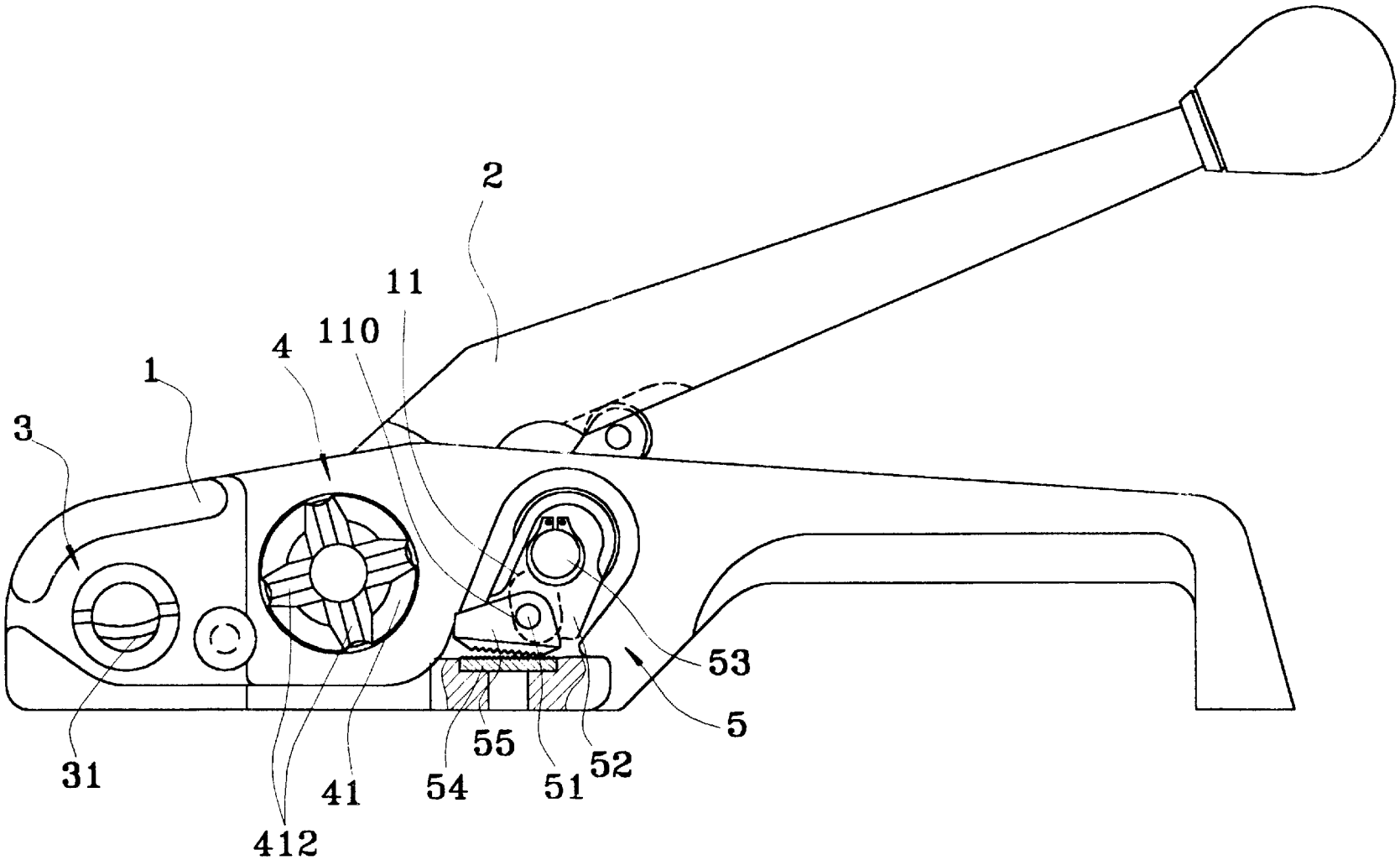
FIG. 1 is a side view of the tightening device of the present invention showing the band holding mechanism.

The present invention is a band tightening apparatus as illustrated in FIGS. 1–4. The tightening apparatus includes a frame 1 on which are mounted a tension handle 2, a cutting means 3, a tightening mechanism 4, a holding mechanism 5, and a return mechanism 6.

Figure 4:
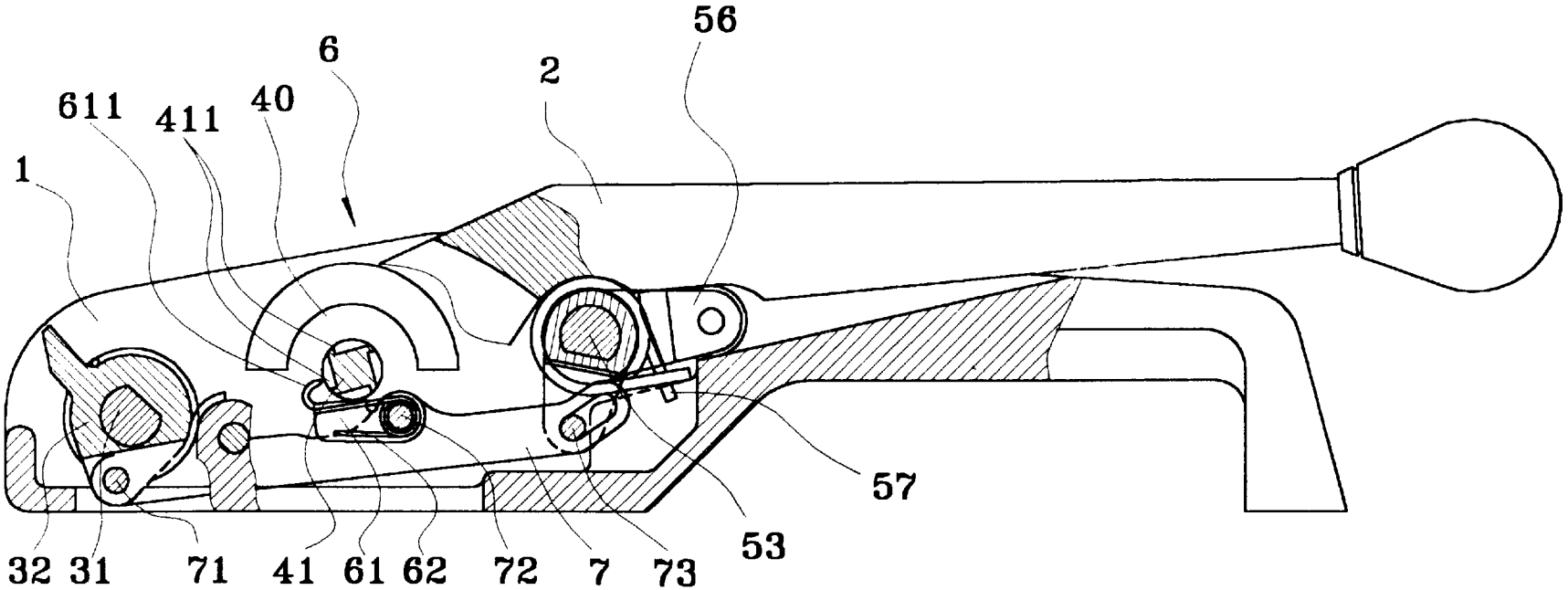
FIG. 4 is a cutaway side view of the tightening device showing the tension handle in the cutting position.

The cutting means 3, situated near a front end of the frame 1, is known in the prior art, and is thus not described in great detail herein. A front end of an elongated actuating arm 7 is connected to a moving cutter 31 of the cutting mechanism 3. The connection is made by means of a clamp 32 secured by an axle pin 71. The cutting mechanism 3 is actuated by a user pressing down the tension handle 2 as illustrated in FIG. 4.

Figure 3A:
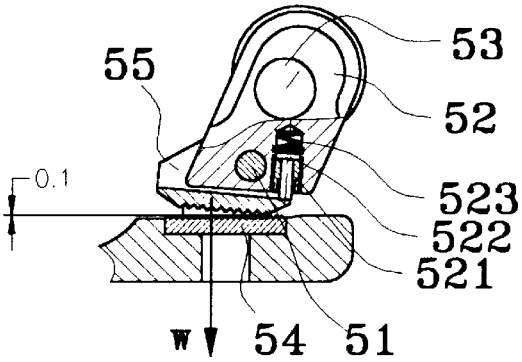
FIGS. 3*a–f* show the band holding mechanism in its various positions during a tightening cycle.
Figure 3B:
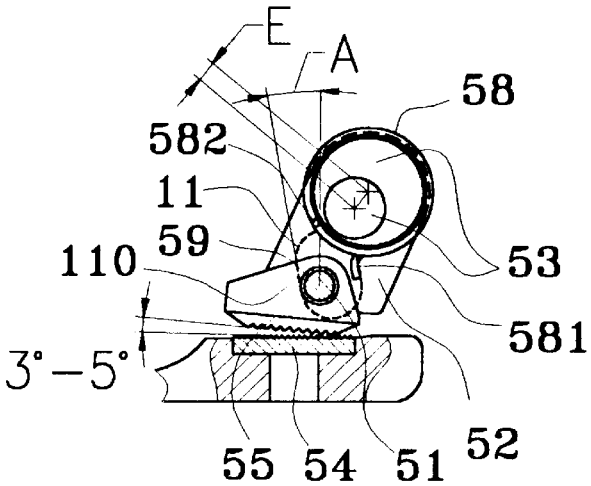

One of the key features of the present invention is a holding mechanism 5 that secures the band while it is being tightened. The holding mechanism 5 comprises an eccentric shaft 53 with a gripper mounting body 52 attached to the offset end of the eccentric shaft 53. The moving gripper plate 55 is pivotally mounted on the mounting body 52 by a gripper shaft 51. The moving gripper plate 55 is pivoted upward at an angle of 3°–50° relative to a stationary gripper plate 54 (FIG. 3*b*). The tendency of moving gripper plate 55 to be pivoted counterclockwise around pin 51 under the influence of its weight W is limited by moving pin 521, which is inserted in a through hole in screw 522 and pushed against gripper plate 55 by a spring 523. The screw 522, pin 521, and spring 523 are placed in a cavity in the gripper mounting body 52.

A roller 59 that facilitates movement of the shaft 51 in slot 11 is mounted on an outer end of shaft 51 and inserted in slot 11 of frame 1. When no force is being exerted via tension handle 2, the moving gripper plate 55 is in the position shown in FIGS. 3*a–b*.

Figure 3C:
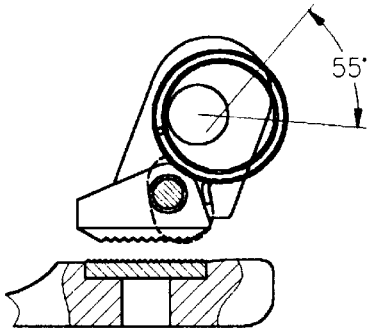

A loading spring 58 is mounted on the eccentric shaft 53. A first end 581 of spring 58 is anchored in slot 11 of the frame 1. The second end 582 of spring 58 pushes against moving gripper mounting body 52, thereby urging shaft 51 with the roller 59 to abut the front surface 110 of slot 11 as shown in FIG. 3*b*. With the tension handle 2 in the cutting position (FIG. 4), the teeth of the moving gripper plate 55 are parallel to and separated from the teeth of the stationary gripper plate 54 as shown in FIG. 3*c*. In this position, it is very easy to load the first end of band between the gripper plates 54, 55.

Figure 3D:
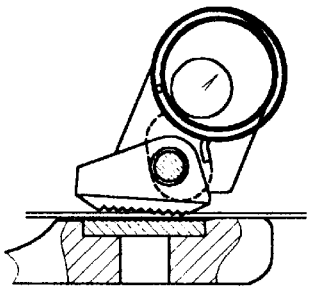
Figure 3E:
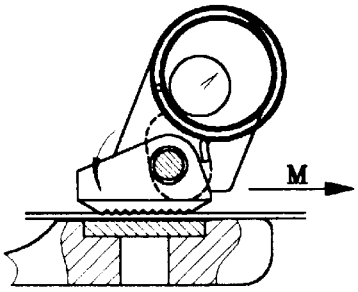
Figure 3F:
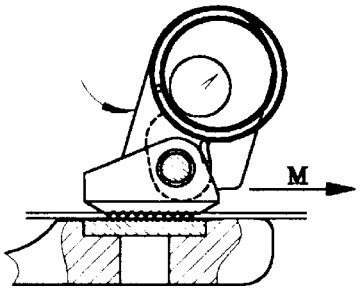

When the user releases tension handle 2, the moving gripper plate 55 falls back to the position shown in FIG. 3*d*. It can be seen that only the rearmost rows of teeth on the moving gripper 55 contact the band, as no tightening force has yet been applied.

Figure 2:
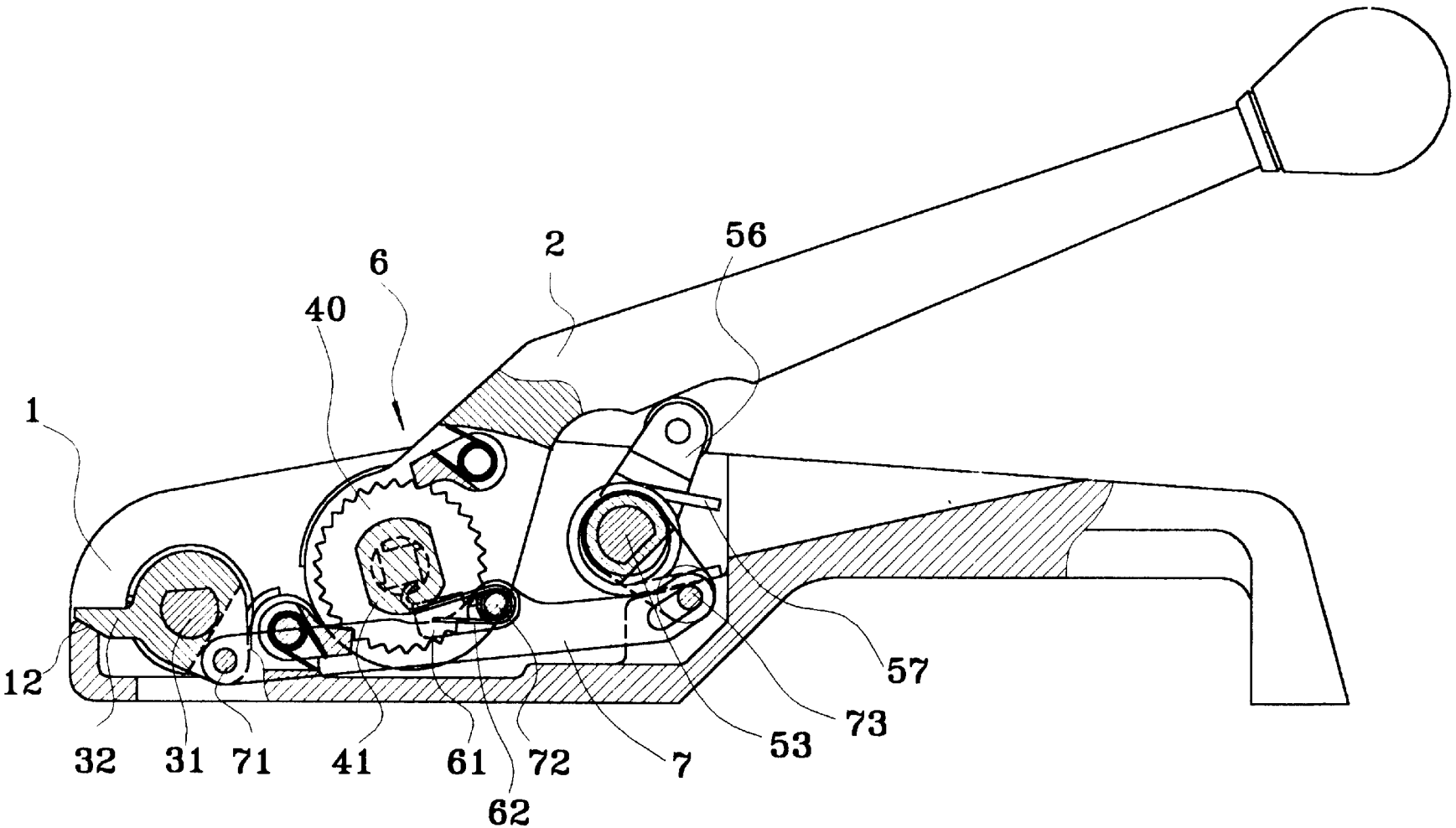
FIG. 2 is a cutaway side view of the tightening device with the tension handle in the initial position.

During the tightening operation, the free end of the band is threaded around the article being bound, and is secured in the windlass 41 of the tightening mechanism 4. Windlass 41 is driven by a ratchet wheel 40 that is mounted on the shaft of the windlass 41 (FIG. 2). As the windlass 41 is ratcheted by tension handle 2 being moved forward and back, the moving gripper plate 55 is forced to the loaded position illustrated in FIGS. 3*e–f* by the tightening force M being applied to the band. Force M drives the front end of moving gripper plate 55 downward so that it is parallel to stationary gripper plate 54. This brings all the teeth on the gripper plates 54, 55 into play to secure the end of the band between the plates 54, 55. This allows the user to continue to ratchet the windlass 41 to tighten the band.

When the band is sufficiently tightened and the ends are secured together by known securing means, the user again pushes tension handle 2 downward to the cutting position, thereby activating the cutting mechanism 3. The moving gripper plate 55 is raised again to the position shown in FIG. 3*c*. When the tension handle 2 is released, spring 57 returns the handle 2 to its initial position shown in FIGS. 1 and 2. Simultaneously, the moving gripper plate 55 is moved back to its initial position by eccentric shaft 53 (see FIGS. 3*a–b*). The end position of the eccentric shaft 53 is determined by a position of lever 56. Lever 56 is connected by pin 73 to actuating arm 7, which is in turn connected by pin 71 to clamp 32. Clamp 32 rests by guide 12 against the frame 1 (FIG. 2). All elements are designed to prevent any contact between the teeth of the moving gripper plate 55 and the stationary gripper plate 54. The clearance between the gripper plates 54, 55 is about 0.1 mm.

Another feature of the present invention is a return mechanism intended to reduce the operation cycle time by returning the windlass 41 to an optimal loading position following each band tightening cycle. At the end of every tightening cycle, slots 412 of the windlass 41 are positioned randomly. In order to make the loading of a new band more convenient and to thereby reduce cycle time, the tightening device of the present invention is equipped with a return mechanism 6 as shown in FIGS. 2 and 4. Return mechanism 6 comprises a pawl 61 which is connected to actuating arm 7 by pin 72, and is subjected to a pushing force from spring 62. The force from spring 62 urges the pawl in a clockwise direction.

When the handle 2 is in the cutting position, the pawl 62 is in the position shown in FIG. 4. When the handle 2 is released, the components of the device return to their initial positions shown in FIG. 2 due to the force supplied by spring 57. In this position, a tooth 611 of pawl 61 engages one of the teeth 411 of the windlass 41. This establishes the position of the slots 412 of the windlass 41 in their optimal loading positions. This provides for convenient loading of the band for the next tightening operation.

Some optimum values (illustrated in FIGS. 3*b–c*) for the device have been found by the inventor to be as follows: The optimum value for the eccentric offset e of eccentric shaft 53 in the standard size device is 3 mm. The optimal at-rest angle between the moving gripper plate and the stationary plate is 3°–5°. The optimal angle A of the front surface of the groove 11 relative to vertical is 10°.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

I claim:

1. A band tightening apparatus comprising:

a tension handle, a cutting means, a tightening mechanism, and a holding mechanism mounted on a frame of said apparatus; wherein said holding mechanism comprises an eccentric shaft with a gripper mounting body attached to an offset end of said eccentric shaft, a moving gripper plate and a stationary gripper plate, said moving gripper plate is pivotally mounted on said mounting body by means of a gripper shaft, said moving gripper plate is mounted so that a front end of said moving gripper plate is angled upward at an angle of 3°–5° relative to said stationary gripper plate, when the band is loaded and tension on said tension handle is removed, a rear end of said moving gripper plate is lowered so that rearmost rows of teeth on said moving gripper contact the band, and when a tightening force is applied by a windlass driven by said tension handle, said moving gripper plate is moved by the tightening force to a loaded position where said moving gripper plate is essentially parallel to said stationary gripper plate, thereby allowing said gripper plates to secure the band, and when the band is sufficiently tightened and secured, the user pushes tension handle downward to a cutting position, thereby activating said cutting mechanism to cut the band.

2. The apparatus of claim 1 wherein:

a return mechanism is also mounted on said frame, said return mechanism comprises a pawl connected to an actuating arm and subjected to a pushing force from a spring, such that when said tension handle is in said cutting position, said pawl does not inhibit rotation of a drive shaft of said windlass, and when said tension handle is released from said cutting position, said actuating arm triggers said return mechanism so that said spring urges a tooth of said pawl to a position where said tooth engages one of a plurality of teeth on said drive shaft of said windlass so that slots in said windlass that receive the band are secured in positions that facilitate loading of the band into said windlass.

* * * * *